United States Patent [19]

Pliefke

[11] Patent Number: 4,614,571

[45] Date of Patent: Sep. 30, 1986

[54] PROCESS FOR ELECTROCHEMICALLY GRAINING STEEL PLATES USED AS OFFSET PRINTING PLATE SUPPORTS, AND AN ELECTROLYTE SOLUTION SUITABLE FOR THE PROCESS

[75] Inventor: Engelbert Pliefke, Wiesbaden, Fed. Rep. of Germany

[73] Assignee: Hoechst Aktiengesellschaft, Frankfurt am Main, Fed. Rep. of Germany

[21] Appl. No.: 751,522

[22] Filed: Jul. 3, 1985

[30] Foreign Application Priority Data

Jul. 4, 1984 [DE] Fed. Rep. of Germany ..... 3424529

[51] Int. Cl.[4] ..... C25F 3/06

[52] U.S. Cl. ..... 204/129.75; 204/129.95

[58] Field of Search ..... 204/129.75, 129.85, 204/129.95

[56] References Cited

U.S. PATENT DOCUMENTS

| | | | |
|---|---|---|---|
| 3,979,212 | 9/1976 | Peters et al. | 96/86 R |
| 4,042,477 | 8/1977 | Anderson | 204/145 |
| 4,269,677 | 5/1981 | Blomsterberg | 204/129.43 |
| 4,294,672 | 10/1981 | Ohba | 204/129.43 |
| 4,431,724 | 2/1984 | Ovchinnikov et al. | 430/302 |

FOREIGN PATENT DOCUMENTS

| | | | |
|---|---|---|---|
| 1242761 | 8/1971 | United Kingdom | 204/145 |

OTHER PUBLICATIONS

Patent Abstracts of Japan, vol. 6, No. 227, C-134, 1105, p. 152 C 134, 11-12-82.

Patent Abstracts of Japan, vol. 5, No. 144 C-71, 816, p. 131 C 71, 9-11-81.

*Primary Examiner*—T. M. Tufariello

*Attorney, Agent, or Firm*—Schwartz, Jeffery, Schwaab, Mack, Blumenthal & Evans

[57] ABSTRACT

Disclosed is a process and an electrolyte solution for electrochemically roughening steel-based supports for offset printing plates. The treatment is carried out in a hydrochloric acid electrolyte which comprises at least one wetting agent inhibitor. As a result, a uniform surface topography of the plates is achieved, while largely avoiding the formation of scars. The roughened plates are corrosion-resistant and can be coated either directly or indirectly after first treating the plates to render them hydrophilic.

18 Claims, No Drawings

PROCESS FOR ELECTROCHEMICALLY GRAINING STEEL PLATES USED AS OFFSET PRINTING PLATE SUPPORTS, AND AN ELECTROLYTE SOLUTION SUITABLE FOR THE PROCESS

BACKGROUND OF THE INVENTION

The present invention relates to a process for treating steel plates for use as offset printing plates. The process produces an anti-corrosive effect on the plates, in addition to uniformly roughening the plate surface. The invention also relates to an electrolyte solution useful in the process.

Offset printing plates which, for simplicity, are hereinafter referred to as printing plates, are generally composed of a support to which as least one radiation-sensitive reproduction layer is applied. The reproduction layer is applied to the support either by the user, in the case of plates which have not been precoated, or by the industrial manufacturer in the case of precoated (presensitized) plates.

The printing plate supports predominantly used comprise metallic materials, principally aluminum and its alloys. However, support plates of normal carbon steel or steel alloys, for example, chrome-nickel steels, manganese steels and the like, are also used.

In order to obtain certain necessary printing plate properties, such as an adhesive capacity for the layer, differentiation of hydrophilic and hydrophobic areas with defined behavior, corrosion properties and surface hardness, which is important for the length of the printing run, the printing plate is, in general, subjected to a pretreatment. This pretreatment includes, for example, a modification by mechanical, chemical or electrochemical roughening, which is also referred to as graining or etching, chemical or electrochemical surface oxidation, treatment with agents which confer hydrophilic properties.

A combination of the above types of modification is frequently used in the modern, largely continuously operating high-speed units of the manufacturers of uncoated or precoated printing plates.

When aluminum or aluminum alloys are used, the modification comprises, in most cases, a combination of mechanical and/or electrochemical roughening and an anodic oxidation, followed, if appropriate, by a stage in which the plate is rendered hydrophilic.

Aluminum-based carrier plates, due to the material, are widely used and have proven largely satisfactory, even though they have a lower mechanical strength and wear resistance than steel plates. However, the aluminum-based support plates are not amenable to advantageous magnetic fixing to the printing cylinders. The desirable property of magnetic fixing is of particular interest for high-speed rotary presses.

In order to eliminate, in particular, this disadvantage of the aluminum-based printing plates, printing plate support formed as sandwich plates, for example, are not being used for certain applications.

For example, German Offenlegungsschrift No. 2,544,295 discloses sandwich plates composed of a base support of aluminum or steel, on which printing and non-printing areas comprising two different metals are present. The printing areas mainly comprise copper, and the non-printing areas comprise chromium. Such sandwich plates are advantageous with respect to magnetic fixing and exhibit strength, buckling resistance and surface hardness. A general disadvantage of the sandwich plates, however, among other things, is their technically complicated manufacture. For the preparation of the layers, precisely adjusted electroplating baths are required, the disposal of which involves effluent problems and many of which also have high energy consumptions. Moreover, adhesion promoters must be applied as intermediate layers in order to ensure adhesive strength of the individual layers to one another and to the base support material. These procedures are expensive in technical implementation. An additional factor contributing to the expense and technical difficulty is that the electrolytes contain multi-component mixtures which must be mutually matched with great accuracy. Moreover, in the case of improper storage and/or development, there is also a certain risk of the layer adhesion being partially loosened.

In order to avoid the demonstrated disadvantages of the sandwich plates, a steel-based printing plate has been developed according to German Offenlegungsschrift No. 3,100,630. Steel as a lithographic support material is sufficiently hydrophilic for a direct formation of non-image area regions; however, it has the disadvantage of being very susceptible to corrosion. In order to provide the plate with corrosion protection, the steel plates are treated with an inhibiting salt solution, for example, a sodium nitrite solution, after the electrochemical roughening in a chloride solution. Subsequently, the light-sensitive coating is applied. The agents used for conferring hydrophilic properties are hexacyanoferrates or hexacyanocobaltates. Compared with the above-mentioned printing plates, these printing plates have the advantage of strength, buckling resistance, magnetic adhesion in the printing presses and a certain corrosion resistance upon storage and/or upon development of the exposed plates and/or during the printing process.

A serious disadvantage of the plates appears, however, in the roughening stage. Depending on the steel grade used (manufacture, composition), the roughening is not sufficiently uniform, as desired for a printing plate support, especially in view of the adhesive strength of the light-sensitive coating which is to be applied. The evaluation by measurement of peak-to-valley heights shows extensive non-uniformity of the plates described above, and especially the formation of so-called pits is to be noted as an unfavorable surface property. The formation of scars results from pitting corrosion mainly on existing defects in the starting material. This produces unfavorable and unavoidable results with respect to the coating and/or development of the plate and hence finally the quality of the later printed image.

SUMMARY OF THE INVENTION

It is therefore an object of the present invention to develop a roughening process for a steel-based printing plate support which results in a printing plate in which the known favorable properties of the steel support material are combined with an improved surface structure.

A more specific object of the present invention is to produce a support material absent pit formation.

An additional object of the present invention is to provide a process for homogeneously roughening the surface of a steel-based printing plate.

A further object is to provide a support material which is corrosion-resistant.

Still another object of the present invention is to provide a process for producing a support material having the above-identified properties, and which can be coated either directly or after an additional stage in order to render the plate hydrophilic.

A still further object of the present invention is to provide an electrolyte solution suitable for the above-discussed process.

In accomplishing the foregoing objects, there has been provided in accordance with one aspect of the present invention, a process for the electrochemical roughening of steel-based printing plate supports in an aqueous electrolyte containing chloride ions, comprising the step of electrochemically roughening a printing plate carrier in an electrolyte comprising hydrochloric acid and at least one wetting agent inhibitor.

In a preferred embodiment of the present invention, the electrolyte further comprises a compound which is soluble in the electrolyte and which forms fluoride ions. In still another embodiment, the electrolyte further comprises a water-soluble iron compound.

Preferably, the roughening step is performed with direct current, the current density of which ranges from about 3 and 130 A/dm$^2$, at a temperature selected from the range of about 20° to 60° C., and for a period of between about 5 and 300 seconds.

The hydrochloric acid concentration ranges between about 1 and 100 g/l, preferably between about 10 and 100 g/l; the wetting agent inhibitor concentration ranges between about 1 and 50 g/l; the fluoride ion-forming compound concentration ranges between about 10 and 100 g/l; and the iron compound concentration ranges between about 10 and 50 g/l.

In accordance with another aspect of the present invention, there has been provided a chloride ion-containing aqueous electrolyte solution for the electrochemical roughening of steel-based printing plate supports which comprises hydrochloric acid and at least one wetting agent inhibitor. In a preferred embodiment, the wetting agent inhibitor is a nitrogen-containing compound, most preferably, an aliphatic or aromatic amine or imine or a quaternary ammonium compound.

Further objects, features and advantages of the invention will be apparent from the detail description of the preferred embodiments which follows.

DETAILED DESCRIPTION OF THE PREFERRED EMBODIMENTS

In the process according to the invention, a steel sheet is roughened by the action of electric current in an electrolyte comprising hydrochloric acid, a corrosion inhibitor with the properties of a wetting agent and, if appropriate, compounds which are soluble in the electrolyte and form fluoride ions.

Steel is to be understood below as all those steels which can be etched with hydrochloric acid, i.e., both unalloyed and appropriately alloyed steels can be used according to the invention. Even though the process is effective with steels of higher carbon content, particularly uniform roughenings are obtained with steel in which the carbon content does not exceed 0.1% by weight, based upon the total weight of the steel.

The wetting agent inhibitors which can be used are those which retard the formation of pits during the etching by hydrochloric acid. In addition to compounds having a neutral reaction, such as for example nonylphenol polyglycol, these include especially N-containing compounds. Amines, imines and quaternary ammonium compounds are particularly suitable.

In the case of coarse grain steels, fluoride ions, in particular, effect an improved attack across the surface of the coarse grain structure to produce a finer grain structure. Compounds which form fluoride ions in the electrolyte and which have proved suitable include, especially, hydrofluoric acid and soluble fluorine compounds, in particular alkali metal fluorides, such as sodium fluoride or double fluorides.

In preferred embodiments, the concentrations of the hydrochloric acid are between about 1 and 100 g/l, advantageously, between about 10 and 100 g/l, those of the compounds forming fluoride ions are between about 10 and 100 g/l, especially between about 15 and 100 g/l, and those of the wetting agent inhibitor are between about 1 and 50 g/l, advantageously between about 1 and 20 g/l.

For stabilizing the electrolyte without adverse effects on the roughening pattern, iron compounds, preferably $FeCl_3$, can also be added in quantities of about 10 to 50 g/l. In a preferred embodiment, direct current is applied in such a way that the sheet which is to be roughened is connected as the anode. If necessary, an antifoam can also be added.

The process according to the invention is carried out either discontinuously or, preferably, continuously with webs of steel or its alloys. In particular, the process parameters in a continuous process are within the following ranges during roughening: temperature of the electrolyte between about 20° and 60° C., current density between about 3 and 130 A/dm$^2$, residence time in the electrolyte for a point of material to be roughened between about 5 and 300 seconds, preferably between about 10 and 300 seconds, and flow velocity of the electrolyte on the surface of the material to be roughened between 5 and 100 cm/second. In discontinuous processes, the required current densities tend toward the lower part, and the residence times toward the upper part, of the particular ranges indicated. A flow of electrolyte is not absolutely necessary in the latter case.

The step of electrochemically roughening the printing plate support material of steel can also be followed by one or more post-treatment steps. Post-treatment is understood here, in particular, as a chemical or electrochemical treatment which renders the steel support hydrophilic, for example, an electrochemical treatment in an aqueous alkali metal silicate solution according to German Offenlegungsschrift No. 2,532,769, an immersion treatment in an aqueous alkali metal silicate solution according to German Offenlegungsschrift No. 1,471,707, or an immersion treatment of the material in an aqueous polyvinylphosphonic acid solution according to German Offenlegungsschrift No. 1,621,478. These post-treatment stages have the particular purpose of additionally increasing the hydrophilic character, already adequate for many applications, of the iron support material, while preserving the desirable properties of the layer.

Layers suitable as light-sensitive reproduction layers are, in principle, all those which, after exposure, if necessary, with subsequent development and/or fixing, give an image-wise surface, from which printing is possible and/or which represents a relief image of an original. These layers are applied to one of the conventional support materials by means of known processes either by the manufacturer of presensitized printing plates or of dry resists or directly by the user.

The light-sensitive reproduction layers include layers such as those described, for example, in "Light-Sensitive Systems" by Jaromir Kosar, John Wiley & Sons publishers, New York 1965 and include: layers which contain unsaturated compounds and in which these compounds are isomerized, rearranged, cyclized or crosslinked on exposure (Kosar, chapter 4); layers which contain photopolymerizable compounds and in which monomers or prepolymers are polymerized on exposure, if appropriate by means of an initiator (Kosar, chapter 5); and layers which contain o-diazo-quinones such as naphthoquinone-diazides, p-diazo-quinones or diazonium salt condensates (Kosar, chapter 7).

Suitable layers also include electrophotographic layers, i.e., those which contain an inorganic or organic photoconductor.

In addition to the light-sensitive substances, the light-sensitive coating can, of course, also contain other conventional ingredients, such as, for example, resins, dyes, pigments, wetting agents, sensitizers, adhesion promoters, indicators or plasticizers as auxiliaries. In particular, the following light-sensitive compositions or compounds can be used in the coating of the carrier materials:

Positive-working o-quinone-diazide compounds, preferably o-naphthoquinone-diazide compounds, which are described, for example, in German Pat. Nos. 854,890, 865,109, 879,203, 894,959, 938,233, 1,109,521, 1,144,705, 1,118,606, 1,120,273 and 1,124,817.

Negative-working condensation products of aromatic diazonium salts and compounds with active carbonyl groups, preferably condensation products of diphenylamine-diazonium salts and formaldehyde, which are described, for example, in German Pat. Nos. 596,731, 1,138,399, 1,138,400, 1,138,401, 1,142,871 and 1,154,123, in U.S. Pat. Nos. 2,679,498 and 3,050,502 and in British Pat. No. 712,606.

Furthermore, negative-working co-condensation products of aromatic diazonium compounds can be used. These compounds include, for example, those compounds described in German Offenlegungsschrift No. 2,024,244, which contain at least one unit of each of the general types $(A\text{-}D)_n$ and B, linked through a divalent bridging member derived from a carbonyl compound capable of condensation. The symbols are here defined as follows: A is the radical of a compound which contains at least two aromatic carbocyclic and/or heterocyclic nuclei and which is capable, in an acid medium, of condensation with an active carbonyl compound in at least one position. D is a diazonium salt group linked to an aromatic carbon atom of A; n is an integer from 1 to 10; and B is the radical of a compound which is free of diazonium groups and which, in an acid medium, is capable of condensation with an active carbonyl compound in at least one position of the molecule.

Positive-working layers, such as those according to German Offenlegungsschrift No. 2,610,842, can be used which contain a compound which eliminates acid on exposure, a compound which has at least one C-O-C group which can be eliminated by acid, for example, an orthocarboxylate group or a carboxylic acid amide-acetal group, and a binder, if appropriate.

Moreover, negative-working layers can be used which comprise photopolymerizable monomers, photoinitiators, binders and, if appropriate, further additives. Examples of the monomers used here are acrylic acid esters and methacrylic acid esters or reaction products of diisocyanates with partial esters of polyhydric alcohols, as described, for example, in U.S. Pat. Nos. 2,760,863 and 3,060,023 and in German Offenlegungsschriften No. 2,064,079 and No. 2,361,041. Suitable photoinitiators include benzoin, benzoin ethers, polynuclear quinones, acridine derivatives, phenazine derivatives, quinoxaline derivatives or synergistic mixtures of various ketones. A large number of soluble organic polymers can be used as the binders, for example, polyacetal resins, polyamides, polyesters, alkyd resins, polyvinyl alcohol, polyvinylpyrrolidone, polyethylene oxide, gelatine or cellulose ethers.

Negative-working layers according to German Offenlegungsschrift No. 3,036,077 can also be used, which contain, as the light-sensitive compound, a diazonium salt polycondensation product or an organic azido compound and, as the binder, a high-molecular polymer with alkenylsulfonylurethane or cycloalkenylsulfonylurethane side groups.

Photo-semiconducting layers, such as are described, for example, in German Pat. Nos. 1,117,391, 1,522,497, 1,572,312, 2,322,046 and 2,322,047, can also be applied to the support materials, whereby highly light-sensitive, electrophotographic layers are produced.

The materials, roughened by the process according to the present invention, for printing plate carriers have a uniform surface topography, which has a positive effect on a steady length of run and the hydrophilic properties during the printing from printing forms prepared with these supports. Few pits (marked depressions as compared with the roughness in the surroundings) arise, and these can be almost completely suppressed. Advantageously, these surface properties can be accomplished without a particularly large outlay for apparatus.

It is possible that, due to the simultaneous action of chloride ions and a wetting agent inhibitor, the passivation of pits is accelerated and a finer surface structure is induced. The addition of fluorine compounds can further reinforce this effect, so that such an addition represents a preferred embodiment.

The present invention is explained in more detail by reference to the examples which follow, without the examples being intended to be a restriction to the embodiments shown. The examples include Examples 1 to 9 and 13 to 24, and Comparison Examples 10 to 12.

Descaled and degreased steel sheets having a surface area of 40×60 cm and a thickness of 0.28 cm were used. The sheets were immersed in a solution corresponding to the electrolyte, in order to remove any pickling residues present. Steel grades having the following composition were used in examples 1 to 9:

$Cr < 0.1\%$
$Mn = 0.2\%$
$Cu < 0.1\%$
$C < 0.1\%$

In examples 13 to 24, the Mn content was 0.4%. The other values correspond to the data for examples 1 to 9.

The sheets were roughened by means of direct current under the conditions indicated in the table. The quality of the roughening was established visually by means of a microscope. The results were classified in 10 quality ratings (surface topography), with a completely homogeneously roughened and pit-free surface being given the quality rating "1". The quality rating "10" corresponds to a surface roughened in a completely irregular manner (very different peak-to-valley heights)

and/or a surface which exhibits thick pits of more than 100 μm depth.

TABLE

| Example No. | HCl concentration g/l | NaF concentration g/l | Type of wetting agent inhibitor | Concentration of the wetting agent inhibitor g/l | Current density A/dm² | Time seconds | Surface topography |
|---|---|---|---|---|---|---|---|
| 1 | 40 | 10 | Dodecor 2725 | 0,5 | 40 | 30 | 2 |
| 2 | 40 | 10 | Dodecor 2725 | 0,5 | 70 | 17 | 1 |
| 3 | 40 | 10 | Dodecor 2725 | 0,5 | 100 | 12 | 1–2 |
| 4 | 40 | 10 | Dodecor 2725 | 1 | 40 | 30 | 2 |
| 5 | 40 | 10 | Dodecor 2725 | 1 | 70 | 17 | 2 |
| 6 | 40 | 10 | Dodecor 2725 | 1 | 100 | 12 | 1 |
| 7 | 40 | — | Dodecor 2725 | 0,5 | 70 | 17 | 2–3 |
| 8 | 40 | — | Dodecor 2725 | 1 | 70 | 17 | 2–3 |
| 9 | 40 | — | Dodecor 2725 | 2 | 70 | 17 | 2–3 |
| V10 | 10 | — | — | — | 70 | 17 | 7 |
| V11 | 40 | — | — | — | 70 | 17 | 6 |
| V12 | 100 | — | — | — | 70 | 17 | 5–6 |
| 13 | 10 | — | Arcopal N-100 | 10 | 70 | 17 | 2–3 |
| 14 | 40 | — | Arcopal N-100 | 10 | 70 | 17 | 2–3 |
| 15 | 100 | — | Arcopal N-100 | 10 | 70 | 17 | 2–3 |
| 16 | 10 | 10 | Dodecor 2725 | 10 | 70 | 17 | 2 |
| 17 | 40 | 10 | Dodecor 2725 | 10 | 70 | 17 | 2 |
| 18 | 100 | 10 | Dodecor 2725 | 10 | 70 | 17 | 2 |
| 19 | 40 | — | Dodigen 5462 | 10 | 20 | 50 | 2 |
| 20 | 20 | — | Dodigen 5462 | 10 | 60 | 25 | 1 |
| 21 | 40 | — | Dodecor 2725 | 20 | 70 | 17 | 1–2 |
| 22 | 40 | — | Dodecor 2725 | 20 | 100 | 10 | 1 |
| 23 | 40 | 40 | Polymin P | 10 | 100 | 12 | 2 |
| 24 | 40 | 40 | Polymin P | 10 | 50 | 24 | 2 |

Arcopal ®, Dodecor ®, Dodigen ® } commercial product of HOECHST AG
Polymin ® commercial product of BASF AG
Arcopal N-100 is a product based on nonylphenol polyglycol
Dodecor 2725, Dodigen 5462 } are quaternary ammonium compounds
Polymin P is a product based on polyethyleneimine

TEST EXPERIMENTS

The plates roughened in accordance with the examples according to the invention were subjected for 17 hours to a conventional endurance test in distilled water at room temperature. No formation of rust was observable after this period. The sheets were also subjected for 5 hours to a corrosion test at room temperature with an aqueous NaCl solution of 50 g/l. Not even a touch of rust was detectable after this time, even at bending points. The plates prepared without a wetting agent inhibitor in accordance with the comparison examples clearly showed rust formation after 17 hours in distilled water, in the above tests. Marked traces of rust appeared after about 2 hours in the NaCl test. After treatment for 5 hours, the sheets were completely covered with rust.

PREPARATION OF PRINTING PLATES

After degreasing, a steel plate was treated in an electrolyte solution which comprised 40 g/l of hydrochloric acid, 10 g/l of sodium fluoride, 5 g/l of Dodecor 2725 and 27 g/l of iron chloride.

The plate was roughened with direct current at a current density of 60 A/dm² for a period of 30 seconds.

The plate thus treated was subjected to a rinsing stage with water, in order to remove the adhering electrolyte, and dried. The roughened plate was provided with a positive-working resist layer which comprised:

6.6 parts by weight of a cresol/formaldehyde novolak (having a softening range of 105°–120° C. according to DIN 53,181), 1.1 parts by weight of 4-(2-phenyl-prop-2-yl)-phenyl-ester of 1,2-naphthoquinone-2-diazide-4-sulfonic acid, 0.6 part by weight of 2,2'-bis-1,2-naphthoquinone-2-diazide-5-sulfonyloxy-1,1'-dinaphthylmethane, 0.24 part by weight of 1,2-naphthoquinone-2-diazide-4-sulfochloride, 0.08 part by weight of crystal violet and 91.36 parts by weight of a mixture of 4 parts by volume of ethylene glycol monomethyl ether, 5 parts by volume of tetrahydrofuran and 1 part by volume of butyl acetate.

After exposure and development, it was possible to produce, without faults, about 25,000 prints with the plate thus produced.

What is claimed is:

1. A process for the electrochemical graining of steel-based printing plate supports in an aqueous electrolyte containing chloride ions, comprising the step of electrochemically graining a steel-based printing plate support in an electrolyte comprising from about 1 to 100 g/l of hydrochloric acid and from about 1 to 50 g/l of at least one wetting agent, corrosion inhibitor, wherein said electrochemical graining step is performed at a current density between about 3 and 130 A/dm² and a temperature of between about 20° and 60° C.

2. The process as claimed in claim 1, wherein said electrolyte further comprises a compound which is soluble in said electrolyte and which forms fluoride ions.

3. The process as claimed in claim 1, wherein said electrolyte further comprises a water-soluble iron compound.

4. The process as claimed in claim 1, wherein said electrolyte includes between about 10 and 100 g/l of said hydrochloric acid.

5. The process as claimed in claim 2, wherein said electrolyte includes between about 10 and 100 g/l of said fluoride ion-forming compound.

6. The process as claimed in claim 3, wherein said electrolyte includes between about 10 and 50 g/l of said iron compound.

7. The process as claimed in claim 1, wherein said wetting agent, corrosion inhibitor comprises at least one nitrogen-containing compound.

8. The process as claimed in claim 1, wherein said graining step employs direct current.

9. The process as claimed in claim 1, wherein said graining step is carried out for a period of between about 5 and 300 seconds.

10. The process as claimed in claim 1, wherein the flow velocity of said electrolyte on the surface of said support to be grained ranges between about 5 and 100 cm/second.

11. A chloride ion-containing aqueous electrolye-solution for the electrochemical graining of steel-based printing plate supports, which comprises from about 1 to 100 g/l of hydrochloric acid and from about 1 to 50 g/l of at least one wetting agent, corrosion inhibitor.

12. The electrolyte solution as claimed in claim 11, which further comprises at least one compound which is soluble in said electrolyte and forms fluoride ions.

13. The electrolyte solution as claimed in claim 11, which further comprises at least one iron compound which is soluble in said electrolyte.

14. The electrolyte solution as claimed in claim 11, wherein the concentration of said hydrochloric acid is within the range from about 10 to 100 g/l.

15. The electrolyte as claimed in claim 12, wherein the concentration of said fluoride ion-forming compound is within the range from about 10 to 100 g/l.

16. The electrolyte solution as claimed in claim 13, wherein the concentration of said iron compound is within the range from about 10 to 50 g/l.

17. The electrolyte solution as claimed in claim 11, wherein said wetting agent, corrosion inhibitor comprises a nitrogen-containing compound.

18. The electrolyte solution as claimed in claim 17, wherein said nitrogen-containing compound comprises an aliphatic or aromatic amine or imine or a quaternary ammonium compound.

* * * * *